US009890983B1

(12) United States Patent
Higgins

(10) Patent No.: US 9,890,983 B1
(45) Date of Patent: Feb. 13, 2018

(54) STEP FLOW CHILLER CONTROL DEVICE AND METHODS THEREFOR

(71) Applicant: Robert Higgins, Las Vegas, NV (US)

(72) Inventor: Robert Higgins, Las Vegas, NV (US)

( * ) Notice: Subject to any disclaimer, the term of this patent is extended or adjusted under 35 U.S.C. 154(b) by 402 days.

(21) Appl. No.: 14/672,587

(22) Filed: Mar. 30, 2015

Related U.S. Application Data

(60) Provisional application No. 61/973,048, filed on Mar. 31, 2014.

(51) Int. Cl.

| | |
|---|---|
| ***F25D 17/06*** | (2006.01) |
| ***F25B 15/00*** | (2006.01) |
| ***F25D 21/06*** | (2006.01) |
| ***F25D 17/04*** | (2006.01) |
| ***F25B 15/12*** | (2006.01) |
| ***F25B 49/04*** | (2006.01) |

(52) U.S. Cl.
CPC ..... *F25B 49/043* (2013.01)

(58) Field of Classification Search
CPC ..... F25B 15/008; F25B 49/043; Y02B 30/62
USPC ..... 62/141, 148, 175, 476; 137/551; 700/291
See application file for complete search history.

(56) References Cited

U.S. PATENT DOCUMENTS 4,269,041 A * 5/1981 Holldorff ..... F25B 15/00 62/476
4,472,947 A * 9/1984 Saito ..... F25B 15/06 62/141
6,185,946 B1 * 2/2001 Hartman ..... F04D 15/029 62/175
6,742,347 B1 * 6/2004 Kolk ..... F25B 49/043 62/148
2011/0022241 A1 * 1/2011 Higgins ..... G06Q 10/06 700/291
2013/0048114 A1 * 2/2013 Rothman ..... F24D 19/1012 137/551
2013/0091880 A1 * 4/2013 Inadomi ..... F25B 1/00 62/119
2013/0125565 A1 * 5/2013 Erpelding ..... F25B 25/005 62/56
2014/0014292 A1 * 1/2014 Rice ..... H05K 7/20745 165/11.1
2014/0372164 A1 * 12/2014 Egan ..... F24F 11/008 705/7.22

(Continued)

OTHER PUBLICATIONS

Paul Kistler, Advantages and Disadvantages of Using Absorption Chillers to Lower Utility Bills, Tech Data Sheet, Apr. 1997, TDS-2041-E&U, Naval Facilities Engineering Service Center.

(Continued)

*Primary Examiner* — Henry Crenshaw
(74) *Attorney, Agent, or Firm* — Lightbulb IP, LLC

(57) ABSTRACT

A Step Flow control device and methods therefore provide instructions to control operation of various absorption chiller components based on measured load or temperature information. Operating an absorption chiller according to Step Flow balances the flow of heat energy through the absorption chiller to increase efficiency and prevent crystallization. The control device may be integrated into various components of an absorption chiller or may be remote therefrom. In this manner, Step Flow can be used in new absorption chiller installations or be used to retrofit existing installations.

17 Claims, 11 Drawing Sheets

(56) References Cited

U.S. PATENT DOCUMENTS

2015/0286196 A1* 10/2015 Acosta Gonzalez ... F04D 27/00
700/19

OTHER PUBLICATIONS

Xiaolin Wang and Hui T. Chui, Absorption Cooling: A Review of Lithium Bromide-Water Chiller Technologies, Recent Patents on Mechanical Engineering, 2009, vol. 2, No. 3, Bentham Science Publishers, Ltd.
Shan K. Wang, Chapter 14 Refrigeration Systems: Absorption, Handbook of Air Conditioning and Refrigeration 2nd Edition, Nov. 2000, McGraw-Hill.
Absorption Chillers Guideline, Southern California Gas Company New Buildings Institute Advanced Design Guideline Series, Nov. 1998, New Buildings Institute.
Single Effect Absorption Chillers & Chiller-Heaters Model WFC-S Service Manual, Aug. 2011, WFCUL-SMC-2A-0811, Yazaki Energy Systems.
Water Fired Chiller/Chiller-Heater WFC-S Series: 10, 20 and 30 RT Cooling, Oct. 2009, SB-WFCS-1009, Yazaki Energy Systems.

* cited by examiner

FIG. 4

| Evaporator Control | |
|---|---|
| **Evaporator STPT Adjustment Variables** | **Value** |
| Time Interval (seconds) | 30.0 |
| $Q_e$ % ***above*** $Q_e$AVG | 10% |
| CHWP Hertz Up | 3.0 |
| $Q_e$ % **below** $Q_e$AVG | 10% |
| CHWP Hertz Down | 3.0 |

| CHWS | $Q_e$ | EP hz | E GPM | E delta | ~ CHWR |
|---|---|---|---|---|---|
| 44 | **10.0** | **60** | **24.2** | **9.9** | **54.0** |
| | 9.0 | 57 | 23.0 | 9.4 | **53.0** |
| | 8.1 | 54 | 21.8 | 8.9 | **53.0** |
| | 7.3 | 51 | 20.6 | 8.5 | **53.0** |
| | 6.6 | 48 | 19.4 | 8.1 | **52.0** |
| | 5.9 | 45 | 18.2 | 7.8 | **52.0** |
| | 5.3 | 42 | 16.9 | 7.5 | **52.0** |
| | 4.8 | 39 | 15.7 | 7.3 | **51.0** |
| | 4.3 | 36 | 14.5 | 7.1 | **51.0** |
| | 3.9 | 33 | 13.3 | 7.0 | **51.0** |
| | 3.5 | 30 | 12.1 | 6.9 | **51.0** |
| | 3.1 | 27 | 10.9 | 6.9 | **51.0** |
| | 2.8 | 24 | 9.7 | 7.0 | **51.0** |
| | 2.5 | 21 | 8.5 | 7.2 | **51.0** |
| | 2.3 | 18 | 7.3 | 7.6 | **52.0** |
| | 2.1 | 15 | 6.1 | 8.2 | **52.0** |
| | 1.9 | 12 | 4.8 | 9.2 | **53.0** |

FIG. 5

| Generator Control | |
|---|---|
| Generator STPT Adjustment Variables | Value |
| Time Interval (seconds) | 30.0 |
| Qg *above* $Q_{eAVG}$ | 1% |
| GP Hertz Up | 3.0 |
| Qg *below* $Q_{eAVG}$ | 1% |
| GP Hertz Down | 3.0 |

| GEFT | $Q_g$ | GP hz | G GPM | G Delta | ~ GLFT |
|---|---|---|---|---|---|
| **200** | **14.3** | **60** | **38.0** | **9.0** | **191.0** |
| | 12.7 | 57 | 36.1 | 8.5 | 191.5 |
| | 11.5 | 54 | 34.2 | 8.0 | 192.0 |
| | 10.3 | 51 | 32.3 | 7.7 | 192.3 |
| | 9.3 | 48 | 30.4 | 7.3 | 192.7 |
| | 8.4 | 45 | 28.5 | 7.0 | 193.0 |
| | 7.5 | 42 | 26.6 | 6.8 | 193.2 |
| | 6.8 | 39 | 24.7 | 6.6 | 193.4 |
| | 6.1 | 36 | 22.8 | 6.4 | 193.6 |
| | 5.5 | 33 | 20.9 | 6.3 | 193.7 |
| | 4.9 | 30 | 19.0 | 6.2 | 193.8 |
| | 4.4 | 27 | 17.1 | 6.2 | 193.8 |
| | 4.0 | 24 | 15.2 | 6.3 | 193.7 |
| | 3.6 | 21 | 13.3 | 6.5 | 193.5 |
| | 3.2 | 18 | 11.4 | 6.8 | 193.2 |

*FIG. 6*

| **Condenser Control** | |
|---|---|
| **Condenser STPT Adjustment Variables** | **Value** |
| Time Interval (seconds) | 15.0 |
| C / E PSID (mm Hg) **above** STPT | 0.5 |
| CWP VFD Hertz Up | 1.0 |
| C / E PSID (mm Hg) **below** STPT | 0.5 |
| CWP VFD Hertz down | 1.0 |

| Condenser Saturated Temperature | Condenser Saturated Pressure | Evaporator Saturated Temperature | Evaporator Saturated Pressure | PSID Set Point (mm Hg) |
|---|---|---|---|---|
| 102 | 52.1 | 60 | 13.3 | 43.0 |
| 101 | 50.6 | 59 | 12.8 | |
| 100 | 49.1 | 58 | 12.3 | |
| 99 | 47.6 | 57 | 11.9 | |
| 98 | 46.2 | 56 | 11.5 | |
| 97 | 44.8 | 55 | 11.1 | |
| 96 | 43.5 | 54 | 10.7 | |
| 95 | 42.2 | 53 | 10.3 | |
| 94 | 40.9 | 52 | 9.9 | |
| 93 | 39.6 | 51 | 9.6 | |
| 92 | 38.4 | 50 | 9.2 | |
| 91 | 37.3 | 49 | 8.9 | |
| 90 | 36.1 | 48 | 8.6 | |
| 89 | 35.0 | 47 | 8.2 | |
| 88 | 33.9 | 46 | 7.9 | |
| 87 | 32.9 | 45 | 7.6 | |
| 86 | 31.8 | 44 | 7.3 | |
| 85 | 30.8 | 43 | 7.1 | |
| 84 | 29.9 | 42 | 6.8 | |
| 83 | 28.9 | 41 | 6.5 | |
| 82 | 28.0 | 40 | 6.3 | |
| 81 | 27.1 | 39 | 6.1 | |

FIG. 7

| Absorber Control | |
|---|---|
| **Absorber STPT Adjustment Variables** | **Value** |
| Time Interval (seconds) | 30.0 |
| Qa % ***above*** Qct- Qc AVG | 2% |
| A VFD Hertz Up | 2.0 |
| Qa % ***below*** Qct- Qc AVG | 2% |
| A VFD Hertz down | 2.0 |

| AWS | $Q_{ct}$ - $Q_c$ | AP Hz | A GPM | A delta | ~ AWR |
|---|---|---|---|---|---|
| **70** | **10.0** | **60** | **40.0** | **6.0** | **76.0** |
| | 9.8 | 58 | 38.7 | 6.1 | 76.1 |
| | 9.6 | 56 | 37.3 | 6.2 | 76.2 |
| | 9.4 | 54 | 36.0 | 6.3 | 76.3 |
| | 9.2 | 52 | 34.7 | 6.4 | 76.4 |
| | 9.0 | 50 | 33.3 | 6.5 | 76.5 |
| | 8.9 | 48 | 32.0 | 6.6 | 76.6 |
| | 8.7 | 46 | 30.7 | 6.8 | 76.8 |
| | 8.5 | 44 | 29.3 | 7.0 | 77.0 |
| | 8.3 | 42 | 28.0 | 7.1 | 77.1 |
| | 8.2 | 40 | 26.7 | 7.4 | 77.4 |
| | 8.0 | 38 | 25.3 | 7.6 | 77.6 |
| | 7.8 | 36 | 24.0 | 7.8 | 77.8 |
| | 7.7 | 34 | 22.7 | 8.1 | 78.1 |
| | 7.5 | 32 | 21.3 | 8.5 | 78.5 |
| | 7.4 | 30 | 20.0 | 8.9 | 78.9 |
| | 7.2 | 28 | 18.7 | 9.3 | 79.3 |

FIG. 8

| AHU Speed Control | |
|---|---|
| **AHU Speed STPT Adjustment Variables** | **Value** |
| Time Interval (seconds) | 30.0 |
| Space AVG ***above*** Space STPT | 2% |
| AHU Hertz Up | 2.0 |
| Space AVG **below** Space STPT | 2% |
| AHU Hertz down | 2.0 |

| OSA DB | SAT STPT |
|---|---|
| 100 | 55 |
| 90 | 57 |
| 80 | 59 |
| 70 | 60 |
| | |
| | |
| | |
| | |

FIG.9

| AHU CHWV Control | |
|---|---|
| **AHU CHWV STPT Adjustment Variables** | **Value** |
| Time Interval (seconds) | 15.0 |
| SAT AVG ***above*** SAT STPT | 2% |
| CHWV Increase | 1% |
| SAT AVG ***below*** SAT STPT | 2% |
| CHWV decrease | 1% |

| OSA DB | Room Temp STPT |
|---|---|
| 100 | 78 |
| 90 | 77 |
| 80 | 76 |
| 70 | 75 |
| 60 | 74 |
| 55 | 73 |
| 50 | 72 |
| 45 | 71 |

FIG. 12

| | EVAPORATOR | | | | CONDENSER | | | | REFRIGERANT PROPERTIES | | | | | | | | |
|---|---|---|---|---|---|---|---|---|---|---|---|---|---|---|---|---|---|
| tons | chws | chws | **chwr** | chwr | **cws** | **cws** | cwr | cws | RE | lbs | Qe | gef | gef | gef | glf | $Q_g$ | **COP** |
| | temp | $h_l$ | **temp** | hv | **temp** | **$h_l$** | temp | $h_l$ | btu/lb | Ref per min/ton | | temp | hv | temp | hv | | **Design** |
| | | | | | | | | | | | | | | | | | |
| 10.0 | 44 | 12.02 | **54** | 1028.46 | **88** | **56.04** | 54 | 22.03 | 972.42 | 0.21 | 120,000 | 190.00 | 1071.40 | 181.00 | 1068.61 | 171,429 | **0.702** |
| 9.0 | 44 | 12.02 | **53** | 1028.46 | **88** | **56.04** | 53 | 21.03 | 976.42 | 0.20 | 108,000 | 190.00 | 1071.40 | 181.00 | 1068.61 | 152,743 | **0.632** |
| 8.1 | 44 | 12.02 | **52** | 1028.46 | **88** | **56.04** | 53 | 21.03 | 980.42 | 0.20 | 97,200 | 190.00 | 1071.40 | 181.00 | 1068.61 | 137,469 | **0.568** |
| 7.3 | 44 | 12.02 | **51** | 1028.14 | **88** | **56.04** | 53 | 21.03 | 984.10 | 0.20 | 87,480 | 190.00 | 1071.40 | 181.00 | 1068.61 | 123,722 | **0.512** |
| 6.6 | 44 | 12.02 | **51** | 1028.14 | **88** | **56.04** | 52 | 20.03 | 988.10 | 0.20 | 78,732 | 190.00 | 1071.40 | 181.00 | 1068.61 | 111,350 | **0.460** |
| 5.9 | 44 | 12.02 | **50** | 1028.14 | **88** | **56.04** | 52 | 20.03 | 992.11 | 0.20 | 70,859 | 190.00 | 1071.40 | 181.00 | 1068.61 | 100,215 | **0.414** |
| 5.3 | 44 | 12.02 | **49** | 1027.82 | **88** | **56.04** | 52 | 20.03 | 995.79 | 0.20 | 63,773 | 190.00 | 1071.40 | 181.00 | 1068.61 | 90,193 | **0.373** |
| 4.8 | 44 | 12.02 | **49** | 1027.82 | **88** | **56.04** | 51 | 19.03 | 999.79 | 0.20 | 57,396 | 190.00 | 1071.40 | 181.00 | 1068.61 | 81,174 | **0.336** |
| 4.3 | 44 | 12.02 | **48** | 1027.82 | **88** | **56.04** | 51 | 19.03 | 999.79 | 0.20 | 51,656 | 190.00 | 1071.40 | 181.00 | 1068.61 | 73,056 | **0.302** |
| 3.9 | 44 | 12.02 | **48** | 1027.82 | **88** | **56.04** | 51 | 19.03 | 999.79 | 0.20 | 46,490 | 190.00 | 1071.40 | 181.00 | 1068.61 | 65,751 | **0.272** |
| 3.5 | 44 | 12.02 | **47** | 1027.82 | **88** | **56.04** | 51 | 19.03 | 999.79 | 0.20 | 41,841 | 190.00 | 1071.40 | 181.00 | 1068.61 | 59,176 | **0.245** |
| 3.1 | 44 | 12.02 | **47** | 1027.82 | **88** | **56.04**<br>**56.04** | 51 | 19.03 | 999.79 | 0.20 | 37,657 | 190.00 | 1071.40 | 181.00 | 1068.61 | 53,258 | **0.220** |
| 2.8 | 44 | 12.02 | **47** | 1027.82 | **88** | **56.04** | 51 | 19.03 | 999.79 | 0.20 | 33,892 | 190.00 | 1071.40 | 181.00 | 1068.61 | 47,932 | **0.198** |
| 2.5 | 44 | 12.02 | **47** | 1028.14 | **88** | **56.04** | 51 | 19.03 | 1000.11 | 0.20 | 30,502 | 190.00 | 1071.40 | 181.00 | 1068.61 | 43,139 | **0.178** |
| 2.3 | 44 | 12.02 | **46** | 1028.14 | **88** | **56.04** | 52 | 20.03 | 1000.11 | 0.20 | 27,452 | 190.00 | 1071.40 | 181.00 | 1068.61 | 38,825 | **0.161** |
| 2.1 | 44 | 12.02 | **46** | 1028.46 | **88** | **56.04** | 52 | 20.03 | 1000.43 | 0.20 | 24,707 | 190.00 | 1071.40 | 181.00 | 1068.61 | 38,825 | **0.144** |
| 1.9 | 44 | 12.02 | **46** | 1028.46 | **88** | **56.04** | 53 | 21.03 | 1000.43 | 0.20 | 22,236 | 190.00 | 1071.40 | 181.00 | 1068.61 | 38,825 | **0.130** |
| 1.0 | 44 | 12.02 | **45** | 1028.46 | **88** | **56.04** | 53 | 21.03 | 1000.43 | 0.20 | 12,000 | 190.00 | 1071.40 | 181.00 | 1068.61 | 38,825 | **0.070** |
| 1.0 | 44 | 12.02 | **45** | 1028.46 | **88** | **56.04** | 53 | 21.03 | 1000.43 | 0.20 | 12,000 | 190.00 | 1071.40 | 181.00 | 1068.61 | 38,825 | **0.070** |
| 1.0 | 44 | 12.02 | **45** | 1028.46 | **88** | **56.04** | 53 | 21.03 | 1000.43 | 0.20 | 12,000 | 190.00 | 1071.40 | 181.00 | 1068.61 | 38,825 | **0.070** |
| 1.0 | 44 | 12.02 | **45** | 1028.46 | **88** | **56.04** | 53 | 21.03 | 1000.43 | 0.20 | 12,000 | 190.00 | 1071.40 | 181.00 | 1068.61 | 38,825 | **0.070** |
| 1.0 | 44 | 12.02 | **45** | 1028.46 | **88** | **56.04** | 53 | 21.03 | 1000.43 | 0.20 | 12,000 | 190.00 | 1071.40 | 181.00 | 1068.61 | 38,825 | **0.070** |
| 1.0 | 44 | 12.02 | **45** | 1028.46 | **88** | **56.04** | 53 | 21.03 | 1000.43 | 0.20 | 12,000 | 190.00 | 1071.40 | 181.00 | 1068.61 | 38,825 | **0.070** |

FIG. 13

| | EVAPORATOR | | | | CONDENSER | | | | REFRIGERANT PROPERTIES | | | | | | | | | |
|---|---|---|---|---|---|---|---|---|---|---|---|---|---|---|---|---|---|---|
| tons | chws | chws | **chwr** | chwr | **cws** | **cws** | cwr | cws | RE | lbs | Qe | gef | gef | gef | glf | $Q_g$ | **COP** | **COPsf** |
| | temp | $h_l$ | **temp** | hv | **temp** | **$h_l$** | temp | $h_l$ | btu/lb | Ref per min/ton | | temp | hv | temp | hv | | **Design** | **%** |
| | | | | | | | | | | | | | | | | | | **Increase** |
| 10.0 | 44 | 12.02 | **53** | 1028.46 | **88** | **56.04** | 54 | 22.03 | 972.42 | 0.21 | 120,000 | 190.00 | 1071.40 | 181.00 | 1068.61 | 171,429 | **0.700** | **0%** |
| 9.0 | 44 | 12.02 | **53** | 1028.46 | **84** | **52.04** | 53 | 21.03 | 976.42 | 0.20 | 108,000 | 190.00 | 1071.40 | 181.00 | 1068.61 | 152,743 | **0.707** | **11%** |
| 8.1 | 44 | 12.02 | **53** | 1028.46 | **80** | **48.04** | 53 | 21.03 | 980.42 | 0.20 | 97,200 | 190.00 | 1071.40 | 181.00 | 1068.61 | 137,469 | **0.707** | **20%** |
| 7.3 | 44 | 12.02 | **52** | 1028.14 | **76** | **44.04** | 53 | 21.03 | 984.10 | 0.20 | 87,480 | 190.00 | 1071.40 | 181.00 | 1068.61 | 123,722 | **0.707** | **28%** |
| 6.6 | 44 | 12.02 | **52** | 1028.14 | **72** | **40.04** | 52 | 20.03 | 988.10 | 0.20 | 78,732 | 190.00 | 1071.40 | 181.00 | 1068.61 | 111,350 | **0.707** | **35%** |
| 5.9 | 44 | 12.02 | **52** | 1028.14 | **68** | **36.03** | 52 | 20.03 | 992.11 | 0.20 | 70,859 | 190.00 | 1071.40 | 181.00 | 1068.61 | 100,215 | **0.707** | **41%** |
| 5.3 | 44 | 12.02 | **51** | 1027.82 | **64** | **32.03** | 52 | 20.03 | 995.79 | 0.20 | 63,773 | 190.00 | 1071.40 | 181.00 | 1068.61 | 90,193 | **0.707** | **47%** |
| 4.8 | 44 | 12.02 | **51** | 1027.82 | **60** | **28.03** | 51 | 19.03 | 999.79 | 0.20 | 57,396 | 190.00 | 1071.40 | 181.00 | 1068.61 | 81,174 | **0.707** | **53%** |
| 4.3 | 44 | 12.02 | **51** | 1027.82 | **60** | **28.03** | 51 | 19.03 | 999.79 | 0.20 | 51,656 | 190.00 | 1071.40 | 181.00 | 1068.61 | 73,056 | **0.707** | **57%** |
| 3.9 | 44 | 12.02 | **51** | 1027.82 | **60** | **28.03** | 51 | 19.03 | 999.79 | 0.20 | 46,490 | 190.00 | 1071.40 | 181.00 | 1068.61 | 65,751 | **0.707** | **62%** |
| 3.5 | 44 | 12.02 | **51** | 1027.82 | **60** | **28.03** | 51 | 19.03 | 999.79 | 0.20 | 41,841 | 190.00 | 1071.40 | 181.00 | 1068.61 | 59,176 | **0.707** | **65%** |
| 3.1 | 44 | 12.02 | **51** | 1027.82 | **60** | **28.03** | 51 | 19.03 | 999.79 | 0.20 | 37,657 | 190.00 | 1071.40 | 181.00 | 1068.61 | 53,258 | **0.707** | **69%** |
| 2.8 | 44 | 12.02 | **51** | 1027.82 | **60** | **28.03** | 51 | 19.03 | 999.79 | 0.20 | 33,892 | 190.00 | 1071.40 | 181.00 | 1068.61 | 47,932 | **0.707** | **72%** |
| 2.5 | 44 | 12.02 | **52** | 1028.14 | **60** | **28.03** | 51 | 19.03 | 1000.11 | 0.20 | 30,502 | 190.00 | 1071.40 | 181.00 | 1068.61 | 43,139 | **0.707** | **75%** |
| 2.3 | 44 | 12.02 | **52** | 1028.14 | **60** | **28.03** | 52 | 20.03 | 1000.11 | 0.20 | 27,452 | 190.00 | 1071.40 | 181.00 | 1068.61 | 38,825 | **0.707** | **77%** |
| 2.1 | 44 | 12.02 | **53** | 1028.46 | **60** | **28.03** | 52 | 20.03 | 1000.43 | 0.20 | 24,707 | 190.00 | 1071.40 | 181.00 | 1068.61 | 38,825 | **0.636** | **77%** |
| 1.9 | 44 | 12.02 | **53** | 1028.46 | **60** | **28.03** | 53 | 21.03 | 1000.43 | 0.20 | 22,236 | 190.00 | 1071.40 | 181.00 | 1068.61 | 38,825 | **0.573** | **77%** |
| 1.0 | 44 | 12.02 | **53** | 1028.46 | **60** | **28.03** | 53 | 21.03 | 1000.43 | 0.20 | 12,000 | 190.00 | 1071.40 | 181.00 | 1068.61 | 38,825 | **0.309** | **77%** |
| 1.0 | 44 | 12.02 | **53** | 1028.46 | **60** | **28.03** | 53 | 21.03 | 1000.43 | 0.20 | 12,000 | 190.00 | 1071.40 | 181.00 | 1068.61 | 38,825 | **0.309** | **77%** |
| 1.0 | 44 | 12.02 | **53** | 1028.46 | **60** | **28.03** | 53 | 21.03 | 1000.43 | 0.20 | 12,000 | 190.00 | 1071.40 | 181.00 | 1068.61 | 38,825 | **0.309** | **77%** |
| 1.0 | 44 | 12.02 | **53** | 1028.46 | **60** | **28.03** | 53 | 21.03 | 1000.43 | 0.20 | 12,000 | 190.00 | 1071.40 | 181.00 | 1068.61 | 38,825 | **0.309** | **77%** |
| 1.0 | 44 | 12.02 | **53** | 1028.46 | **60** | **28.03** | 53 | 21.03 | 1000.43 | 0.20 | 12,000 | 190.00 | 1071.40 | 181.00 | 1068.61 | 38,825 | **0.309** | **77%** |
| 1.0 | 44 | 12.02 | **53** | 1028.46 | **60** | **28.03** | 53 | 21.03 | 1000.43 | 0.20 | 12,000 | 190.00 | 1071.40 | 181.00 | 1068.61 | 38,825 | **0.309** | **77%** |
| 1.0 | 44 | 12.02 | **53** | 1028.46 | **60** | **28.03** | 53 | 21.03 | 1000.43 | 0.20 | 12,000 | 190.00 | 1071.40 | 181.00 | 1068.61 | 38,825 | **0.309** | **77%** |

STEP FLOW CHILLER CONTROL DEVICE AND METHODS THEREFOR

CROSS-REFERENCE TO RELATED APPLICATION

This application claims priority to U.S. Provisional Patent Application No. 61/973,048 filed Mar. 31, 2014.

BACKGROUND OF THE INVENTION

Field of the Invention

The invention relates generally to absorption chillers and in particular to a step flow controller and methods therefor for improving coefficient of performance of absorption chillers by balancing the flow of energy through an absorption chiller while preventing absorbent solution crystallization.

Related Art

Absorption cooling is founded on well-established principals developed in the late 1700s. Instead of relying upon an electrically powered compressor, absorption cooling utilizes heat as energy to cool a building or other structure. This is highly advantageous today due to the combination of ever increasing rates for electrical power and the desire to provide cooling utilizing environmentally friendly methods. In addition, heat energy can be produced in a multitude of ways, and is often already produced by the various mechanical systems of a building. Also, the step of generating electrical power, as found in compressor driven cooling methods, can be avoided altogether.

It can be seen from these attributes why absorption cooling is attractive as a cooling technique in theory. However, various drawbacks to absorption cooling continue to exist with regard to absorption chillers. Though improvements to absorption chillers, such as automated purge systems and lower water flow requirements have addressed some of these drawbacks significant issues continue to persist, which at the very least hinder the adoption of absorption cooling in many circumstances.

From the discussion that follows, it will become apparent that the present invention addresses the deficiencies associated with the prior art while providing numerous additional advantages and benefits not contemplated or possible with prior art constructions.

SUMMARY OF THE INVENTION

A Step Flow ("SF") control device for absorption chillers and methods therefore are disclosed herein. As will be described herein, the use of SF at an adsorption chiller is highly advantageous in that it improves efficiency, helps prevent solar field depletion, balances evaporator and generator load, and subcools the absorbent. In addition, SF is easily added to or integrated into traditional adsorption chillers.

Various embodiments of SF are disclosed herein. For instance, in one exemplary embodiment a control device for controlling an absorption chiller is disclosed, with such control device comprising an input configured to receive a plurality of current load values from a component of the absorption chiller, a memory device storing a control sequence defining a speed increase and a speed decrease in hertz, an output in communication with a variable frequency drive of the component, and a processor.

The processor receives a predefined number of the plurality of current load values via the input, averages the predefined number of the plurality of current load values to generate an average load value, and compares the average load value to one of the plurality of current load values to determine whether the average load value is greater or less than the one of the plurality of current load values. The processor also increases speed at the variable frequency drive by the speed increase or decreases speed at the variable frequency drive by the speed decrease based on the comparison of the average load value to the one of the plurality of current load values.

It is noted that the processor might only increase or decrease speed at the variable frequency drive when the comparison reveals that the average load value is larger than the one of the plurality of current load values by at least a predefined threshold amount. The processor may also initially commands the variable frequency drive of the component to start at full speed via the output.

The processor may also receive a second plurality of current load values from a second component of the absorption chiller. In such case, the processor may average the second plurality of current load values and increase or decrease the speed of a variable frequency drive of the second component based on a comparison between an average load value of the second plurality of current load values and one of the second plurality of current load values.

A clock may be provided and, if so, the input may receive each of the plurality of current load values at a predefined interval defined by the clock. Also, the component may be selected from the group consisting of an evaporator, absorber, heat exchanger, generator and condenser of the absorption chiller.

In another exemplary embodiment, a controller for an absorption chiller is disclosed, with such controller comprising one or more inputs that receive a plurality of current load values from an absorption chiller component, one or more outputs that transmit one or more control signals to a variable frequency drive of the absorption chiller component, one or more processors. The component is selected from the group consisting of an evaporator, absorber, heat exchanger, generator and condenser The processors receive the plurality of current load values received by the inputs, generate an average load value from a subset of the plurality of current load values when a predefined number of current load values has been received, compare the average load value to one of the plurality of current load values, and increase or decrease speed at the variable frequency drive by at least one of a plurality of predefined frequencies based on the difference of the average load value to the one of the plurality of current load values. The one of the plurality of current load values may be the current load value most recently received at the inputs.

The processor might only increases or decreases speed at the variable frequency drive when the comparison reveals that the average load value is larger or smaller than the one of the plurality of current load values by at least a predefined threshold amount. Also, the processor may initially commands the variable frequency drive of the component to start at full speed via the output.

A memory device for storing the plurality of predefined frequencies may be included. Also, a clock may be provided and, if so, the inputs may receive each of the plurality of current load values at a predefined interval defined by the clock. One or more sensors in communication with the inputs may be included as well. In such case, the plurality of current load values can be determined by the sensors.

Various methods are disclosed herein as well. For example, in one exemplary embodiment, a control device implemented method for controlling an absorption chiller is disclosed, with such method comprising receiving a plurality of current load values from a component of the absorption chiller via one or more sensors, wherein receipt of each of the plurality of current load values is triggered by a clock of the control device, determining if a predefined number of current load values have been received via a processor of the control device, and upon receiving the predefined number of current load values, generating an average load value from a subset of the plurality of current load values with the processor. The component may be selected from the group consisting of an evaporator, absorber, heat exchanger, generator and condenser of the absorption chiller.

The method also includes comparing the average load value to a selected one of the plurality of current load values, and increasing or decreasing the speed at a variable frequency drive of the component by at least one of a predefined plurality of frequencies based on the difference between the average load value and the selected one of the plurality of current load values. The speed is only increased or decreased if the difference is larger than a predefined threshold amount.

It is contemplated that increasing or decreasing the speed may occur by signaling the variable frequency drive with an output of the control device. The plurality of predefined frequencies may be stored on a memory device of the control device. Also, the clock triggers receipt of each of the plurality of current load values at a static predefined time interval. The component may be initialized by signaling its variable frequency drive to start at full speed via an output of the control device.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The components in the figures are not necessarily to scale, emphasis instead being placed upon illustrating the principles of the invention. In the figures, like reference numerals designate corresponding parts throughout the different views.

FIG. 4 illustrates an exemplary SF evaporator control sequence and operation thereof;

FIG. 5 illustrates an exemplary SF generator control sequence and operation thereof;

FIG. 6 illustrates an exemplary SF condenser control sequence and operation thereof;

FIG. 7 illustrates an exemplary SF absorber control sequence and operation thereof;

FIG. 8 illustrates an exemplary SF air handling unit control sequence and operation thereof;

FIG. 9 illustrates an exemplary SF water valve control sequence and operation thereof;

FIG. 12 is a table illustrating operating conditions at an exemplary adsorption chiller without SF; and FIG. 13 is a table illustrating operating conditions of an exemplary adsorption chiller utilizing SF.

DETAILED DESCRIPTION OF THE INVENTION

Figure 1:
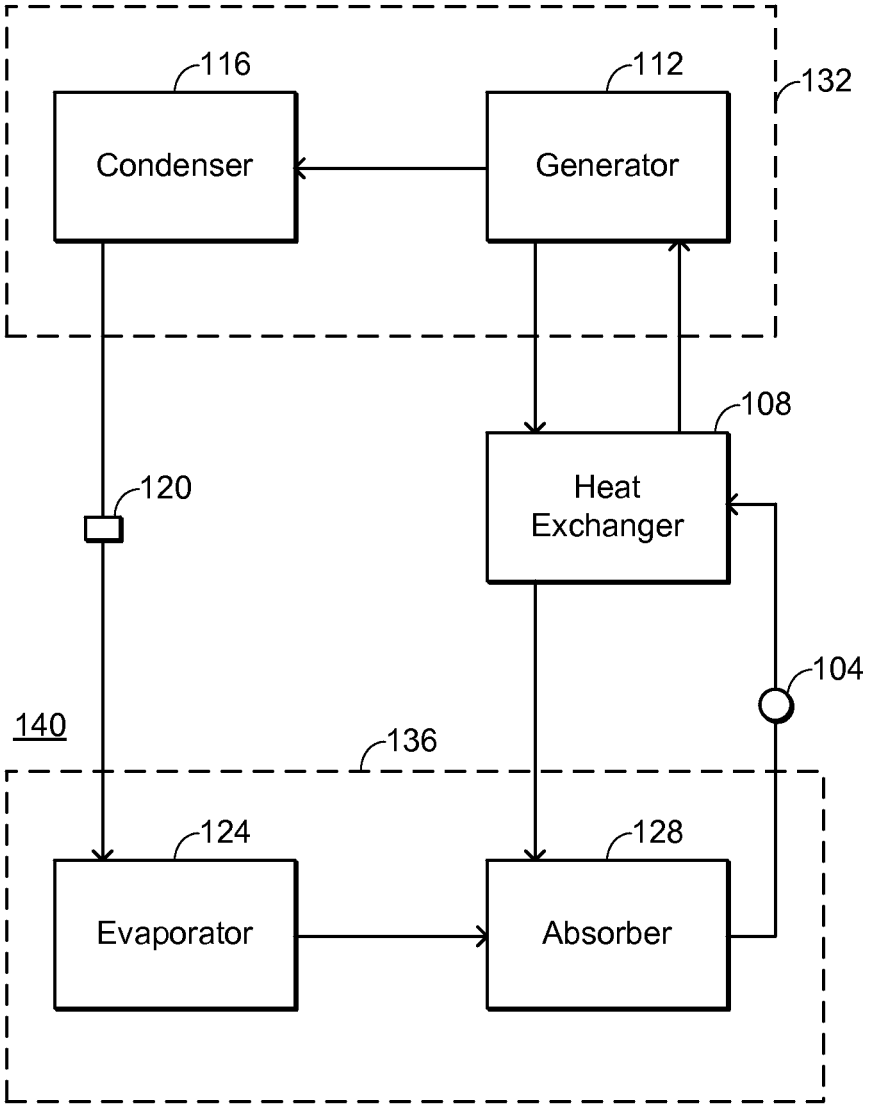
FIG. 1 (Prior Art)
FIG. 1 is a block diagram of an exemplary absorption chiller.

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

In general, SF is a control strategy that balances the flow of heat energy through an absorption chiller in order to improve machine and system coefficient of performance ("COP") while also preventing crystallization of the lithium bromide salt ("LiBr salt"). SF determines pumping control logic for air handling units ("AHUs") as well as the evaporator, generator, condenser, and absorber pumps associated with an absorption chiller. SF also allows the condenser and absorber pumps to operate at beyond non-traditional condensing water entering temperatures ("CWET") and flow rates which improve the efficiency of the refrigerant while maintaining critical differential pressures and temperatures within an absorption chiller thereby preventing crystallization of the LiBr salt.

The balance of heat energy flow is advantageous in terms of efficiency gain and dependability because it reduces the likelihood of crystallization in an absorption chiller. This is in contrast to traditional absorption chillers, which move virtually the entire volume of the refrigerant through every cycle. That means every pound of refrigerant (i.e., water) in such absorption chiller has to be vaporized in the generator, condensed in the condenser, waste heat rejected via the cooling tower and then passed into the evaporator every cycle.

However, when the refrigerant reaches the evaporator only the portion needed for cooling is vaporized and absorbed by the LiBr (becoming a strong solution) and the rest of the unused refrigerant falls as a liquid via gravity to the collection basin where it is mixed with this strong LiBr/refrigerant solution and pumped back into the generator via the solution pump to start the next cycle. With SF heat energy is varied by adjusting LIBr/refrigerant flow rates and only the amount of heat is added to the generator to drive out the refrigerant that is actually needed to meet the cooling demand of the building. In this manner, the generator, condenser, cooling tower fan and absorber energy are not wasted just to keep the refrigerant in circulation. Instead, the refrigerant flows back into the absorber as a strong solution that reduces the potential for crystallization.

SF can be applied external to all absorption chiller control algorithms to influence the efficiency of an absorption chiller independent of its local controller. The overall goal of SF is to improve absorption chiller efficiency as well as overall cooling system efficiency. As will be described further below, SF provides consistent maintenance of the critical pressure and temperature differences between the evaporator, generator, condenser and absorber at all times in order to prevent crystallization of LiBr salt. This prevents efficiency losses or worse because crystallization can stop the cooling process in an absorption chiller entirely and require costly and time-consuming repair to remedy. In addition, SF allows absorption chillers to be easily added to existing plants having traditional electrically/compressor driven chillers. This is because SF is configured to automatically balance the flow of heat energy through an absorption chiller, in various environments, including when the absorption chiller is in a hybrid system with traditional electrically/compressor or other types of chillers.

A single stage absorption refrigeration cycle will now be described with regard to FIG. 1. FIG. 1 is a block diagram illustrating a typical single stage LiBr absorption chiller 140. During the refrigerant cycle, as the dilute (i.e., weak) solution leaves the solution pump 104 it enters the low temperature side of the heat exchanger 108. As the dilute solution passes through the heat exchanger 108 it picks up heat from the concentrated (i.e., strong) solution leaving the generator 112, which passes through the high temperature side of the heat exchanger 108 on its way back to the absorber 128 via gravity.

The now pre-heated dilute solution moves through the heat exchanger 108 into the generator 112 where it is superheated and releases its refrigerant vapor. The superheated refrigerant vapor rises to the top of the generator 112 where it is drawn into the much cooler and relatively lower pressure condenser 116. The concentrated solution flows from the generator 112 through the previously mentioned heat exchanger 112 and back into the absorber 128, as will be discussed further below.

As the superheated refrigerant vapor leaves the generator 112 it is drawn into the condenser 116, due to the lower temperature and pressure, where it is condensed back into liquid refrigerant and sub cooled. The pressure difference between the upper chamber 132 of the absorption chiller 140, which contains the generator 112 and condenser 116, is roughly eight times greater than in the lower chamber 136 which contains the evaporator 124 and absorber 128.

For example, at an exemplary design operating condition the pressure at the upper chamber 132 may be roughly 50 mmHg, while the pressure at the lower chamber 136 may be about 6.5 mmHg. This pressure difference between the upper and lower chambers 132, 136 forces the sub cooled liquid refrigerant through an expansion valve 120, which separates the upper and lower chambers, and into the evaporator 124.

Upon entering the evaporator 124 the sub cooled refrigerant is exposed to the lower pressure and boils as it comes in contact with the now much warmer evaporator surface temperature, which in this example may be approximately 54° F. chilled water return temperature ("CHWR") at design conditions. Due to the lower pressure of the evaporator 124 pressure the liquid refrigerant boils at about 39° F. and flashes to steam as it contacts the 54° F. evaporator (CHWR). The now superheated refrigerant is drawn (back) into the absorber 128 by the force of the concentrated LiBr solution's very strong affinity for the refrigerant vapor. Heat is removed from the concentrated solution (via cooling tower water) as it enters the absorber 128 dropping its temperature from about 105° F. to 95° F.

As the refrigerant combines with the LiBr several things happen at once. First, a lower pressure is created in the absorber 128 as the refrigerant and LiBr combines aiding the flow of superheated refrigerant vapor into the absorber 128. Second, the LiBr refrigerant solution becomes more concentrated. Third, heat is released as the superheated refrigerant vapor combines with the LiBr salt (i.e., the heat of absorption) causing the now concentrated solution to rise in temperature to around 95° F. at design conditions. The cycle is now completed as the refrigerant moves back into the heat exchanger 108 via the solution pump 104.

Figure 2:
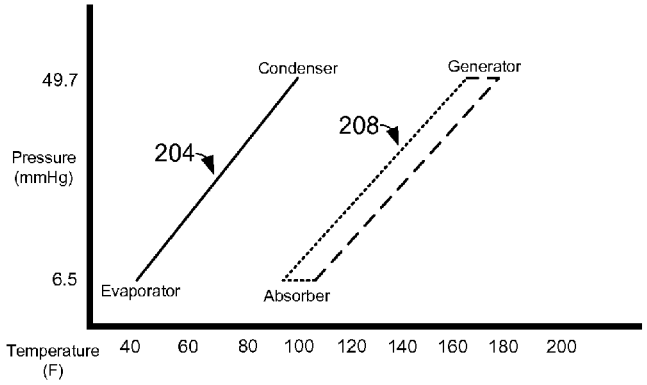
FIG. 2 is a Duhring chart illustrating the temperature/pressure relationship in an exemplary absorption chiller.

The Duhring chart of FIG. 2 graphically illustrates the relationship between temperature and pressure in a single stage absorber. The diagonal line 204 on the left side of the chart details the pressure/temperature characteristics of the refrigerant (water) as it moves through the refrigeration cycle. The parallelogram 208 on the right side of the chart details the pressure/temperature characteristics of the dilute/concentrated solution as it moves through the refrigeration cycle and the corresponding components of an absorption chiller.

I. Step Flow Narrative

Figure 3:
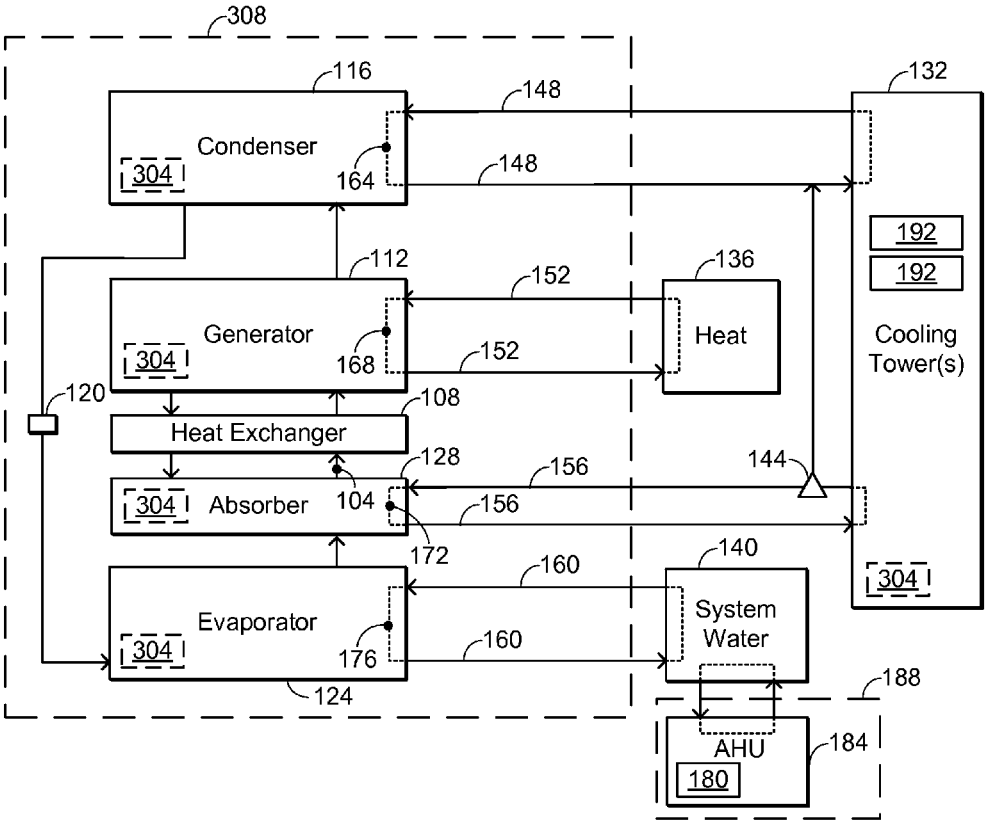
FIG. 3 is a block diagram of an exemplary absorption chiller.

SF will now be described with reference to the exemplary absorption chiller 304 of FIG. 3. Though described with regard to exemplary single stage absorption chillers that use Lithium Bromide ("LiBr") as the absorbent (and with generator temperatures less than 200° F.), it is noted that SF can be used in various other chillers, including but not limited to other LiBr absorption chillers and/or multi-stage absorption chillers.

SF is configured to operate with and control existing absorption chillers. As shown in FIG. 3 for example, one or more control devices 304 may implement SF at an absorption chiller 308, and individual components thereof. To illustrate, a control device 304 may be configured to control components of an absorption chiller 308 according to the SF control logic as disclosed herein. A control device 304 may be part of or act upon an absorption chiller's 308 individual components, such as shown, or may be in remote communication therewith to control such component according the SF. It is contemplated that a single control device 304 may control one or multiple components of an absorption chiller 308. As shown in the exemplary embodiment of FIG. 3 for instance, the condenser 116, generator 112, absorber 104, evaporator 124, and cooling tower 132 components of the absorption chiller 308 each have their own control device 308.

The condenser 116, generator 112, heat exchanger 108, absorber 128, evaporator 124, expansion valve 120 and pump 104 may operate in the same manner as described above with FIG. 1. Generally speaking, SF acts upon variable frequency drives ("VFDs") to control pump or fan speeds to provide benefits to the absorption chiller's efficiency and prevent crystallization. SF can control pumping and blower speeds in other ways as well.

As will be described further below, SF controls the VFDs of various pumps 164, 168, 172, 176 or fans 180 (such as that of an air handling unit 184) to achieve these goals. In operation, the control device 304 receives information about the operating characteristics of the absorption chiller 308 at various locations. The control device 304 can then increase or decrease the speed by signaling the appropriate VFD. Though shown within the components of the absorption chiller 308, it is noted that the pumps 164, 168, 172, 176 can be external to such components, such as on a water line or conduit 148, 152, 156, 160 connected to the component.

As will now be described with regard to FIGS. 4-9 (with reference to FIG. 3), pump or fan VFDs are operated according to SF to improve efficiency of an absorption chiller 308. This is advantageous in that absorption chillers 308 operate most efficiently within a considerably small range of operating parameters, especially relative to other chilled water generation systems, such as condenser-based chillers.

In FIGS. 4-9, a "Control" table illustrates exemplary instructions created or programmed during SF installation, commissioning, or maintenance. These instructions, also referred to herein as control sequences, can then be executed by a control device 304 during operation of an absorption chiller. FIGS. 4-9 also illustrate exemplary average values, abbreviated "AVG" that are obtained by averaging a plurality of the variable of like name. To illustrate, QeAVG (average evaporator load) is an average of a plurality of Qe values.

A. Evaporator

The SF process starts in the evaporator 124 where building load, such as at building 188, determines the flow rate ("GPM") of water through the building distribution system 140 or loop. As will now be disclosed, SF may be used to control evaporator flow rate (E GPM) by varying E GPM as the average load changes by a predefined percent. When used to control an evaporator 124, SF (i.e., the control device 304) compares current evaporator load, Qe, to an averaged evaporator load, QeAVG. In one exemplary embodiment, Qe values are averaged 4 times per minute to determine the resultant QeAVG value. It is noted that averaging may occur more or less often during a time period if desired. The real time load on the evaporator will typically be calculated via the formula: Qe=E GPM*E Delta T/24, where E GPM is the water flow rate at the evaporator and E Delta T is the chilled water fluid temperature difference across the evaporator.

In operation, the evaporator pump ("EP") 176 starts at full speed via its variable frequency drive ("VFD") with its ramp down timer set to a predefined time duration, for example 15 minutes. According to SF, the EP VFD then resets its speed from that point based on the real time Qe value relative to its average value QeAVG as shown in FIG. 4. To illustrate, if the absorption chiller's design conditions set E GPM=24.2 and E Delta T=9.9 then Qe=24*9.9/24 or Qe~10 Tons (120,000 BTU/hour) for the purpose of this example.

The values in the Evaporator Control section of FIG. 4 are examples of instructions created or programmed during SF installation/commissioning that set the control output signal sent to the EP VFD. The control sequence executes at predefined time intervals, such as for example every 30 seconds. When Qe increases a predefined amount, such as 10% above QeAVG, the EP VFD speed (shown in Hz) is increased. In this example EP VFD speed is increased by 3 Hz. In like manner when the Qe decreases a predefined amount, such as 10% below QeAVG, the EP VFD speed is decreased by a predefined amount, such as by 3 Hz. The resultant values expected in the evaporator as EP VFD changes speed are detailed in the bottom table of FIG. 4 as well. The leaving chilled water set point for the absorption chiller is set at 44° F. for this example.

B. Generator

Now that the measured Qe has been calculated the generator 112 must produce enough heat, Qg, to generate the quantity of refrigerant (water vapor) necessary to satisfy that building load. The generator 112 is not 100% efficient so for the purpose of this narrative generator efficiency is calculated from absorption chiller submittal heat input for the evaporator 124 and generator or 120 mbh/171.4 mbh respectively, which is approximately 70% efficiency. For purposes of this discussion, Qg is considered to have this efficiency factored into all equations.

As was seen in FIG. 1 a dilute solution of refrigerant and absorbent is pumped into the generator 112. The generator 112 vaporizes the liquid refrigerant in the dilute solution driving it into the condenser at an energy cost of ~1000 BTU/LB. The condenser 116 in turn has to condense that same refrigerant back to liquid at about the same rate of ~1000/BTU/LB. Left at full heat input temperature and full flow the generator 112 will drive as much refrigerant from the dilute solution as possible, regardless of evaporator load. As the refrigerant flows back into the evaporator 124 from the condenser 116 only the refrigerant that is needed to meet the current load is vaporized and the remainder goes back into the dilute solution as a liquid to start the cycle all over again. Therefore, the portion of refrigerant that is vaporized in the generator 112 above current evaporator 124 load does no useful work ("RE") and actually has a negative impact on the cycle efficiency of about 2000 BTU/LB.

At times when the generator 112 is producing more refrigerant than it needs absorption chiller efficiency is greatly reduced as well as unnecessary depletion of the heat energy 136 from a solar field or other energy source is unnecessarily used at the generator. That said, if the temperature of fluid entering the generator ("GFET") is too low to vaporize enough refrigerant or the temperature of the fluid leaving the heat exchanger of the generator 112 ("GFLT") is too low to produce a high enough refrigerant vapor pressure necessary to drive it into the condenser the refrigeration cycle slows or stops.

SF is highly advantageous in this regard, in that, it balances the production of refrigerant in the generator 112 with the need for refrigerant in the evaporator 124 while maintaining critical differential temperatures and pressures in the absorption chiller 308 as specified by the chiller's manufacturer. Therefore, a fundamental premise of SF is that at reduced generator flows/temperatures the GFLT must always be equal to or greater than the full flow GFLT at the minimum specified evaporator load. This ensures necessary refrigerant vapor production and minimum pressures are maintained in the generator 112 according to manufacturer design intent.

i) Generator Step Flow Control Logic

In order to determine the correct generator flow SF uses the following formula Qg=(G GPM*G Delta T/24)/(0.7) to calculate the current load on the generator, where G GPM is generator flow rate and G Delta T is generator Delta T. SF adjusts generator pump ("GP") 168 speed, via its VFD, to balance Qe and Qg using Qe as the control set point ("STPT") as detailed in FIG. 5.

The GP VFD starts at full speed, as shown in FIG. 5, by having its VFD set to 60 Hz, with a ramp down timer set to a predefined time interval, such as 30 seconds for instance. According to SF, the GP VFD then resets its speed from that point based on the real time Qg value relative to QeAVG as shown in FIG. 5. If, for example, the absorption chiller's design conditions set generator flow rate ("G GPM") equal to 38.0 and generator Delta T ("G Delta T") equal to 9.0 then Qg=38*9/24/0.7 or Qg=~14.3 Tons (171,400 BTU/hour). The values in the Generator Control portion of FIG. 5 are examples of instructions created or programmed during SF installation/commissioning that sets the control output signal sent to the GP VFD.

In this example this control sequence executes at a predefined time interval, such as every 30 seconds. When the Qg increases a predefined amount, such as 1% above QeAVG the GP VFD speed is increased by 3 Hz. In like manner when the Qg decreases 3% below QeAVG the GP VFD speed is decreased by 3 Hz. The resultant values expected in the generator as the GP VFD changes speed are detailed in FIG. 5 as well. The generator entering fluid temperature ("GEFT") is set for 200° F. in this example.

C. Condenser

As with traditional vapor compression cycles the condenser 116 in an absorption chiller 308 is responsible for condensing the refrigerant vapor back into its liquid state while maintaining enough pressure to drive the liquid refrigerant back into the evaporator 124. The more heat that the condenser 116 can remove from the liquid after it is condensed (i.e., the amount of subcooling the condenser can produce), the more efficient the refrigeration cycle becomes (higher RE).

As with traditional vapor compression cycles, the amount of refrigerant subcooling in the condenser 116 is set by the CWET and the saturated refrigerant pressure is set by the CWLT. SF operates one or more cooling tower fans 192, via their respective VFDs, to achieve the minimum allowable CWET based on chiller submittal data and environmental conditions. This allows for greater refrigerant production and subcooling in the condenser 116. Therefore, a fundamental SF premise is that at variable condenser flows/temperature the saturated refrigerant pressure differential between the high and low side chambers must always be at the manufacturer specified minimum (mmHg). SF ensures that refrigerant production and subcooling are maximized while maintaining the minimum pressure differential necessary to insure proper refrigerant flow back into the evaporator.

i) Cooling Tower Load

The load on the cooling tower 132 is a sum of the evaporator load, generator load and the absorber load. Therefore, if Qc=Qg+Qe then the total load on the cooling tower, Qct, is the sum of Qc+the heat produced in the absorber, Qa, or Qct=Qc+Qa. However, in reality only part of the heat rejected from the generator 112 flows into the condenser 116 as refrigerant vapor. Some of the energy released in the generator 112 flows back thru the sub-cooler heat exchanger 108 and ultimately back into the absorber 128 as proven by the elevated concentrated solution temperature entering the absorber. This can be represented by the revised equation Qc=Qe+X % of Qg. The X % component of Qg removed in the absorber 128 plus the heat of absorption can be calculated from the formula Qa=AP GPM*Delta T/24, where AP GPM is flow rate at an absorber pump 172. However, the actual X % component of Qg in Qa is difficult to derive due to subcooling heat exchangers and other machine dynamics. Therefore, to aid in understanding Qc is assumed to be the total Qe+Qg as described herein.

ii) Condenser Step Flow Logic:

SF adjusts condenser water pump ("CWP") 164 speed, via its VFD, to maintain the minimum evaporator and condenser saturated refrigerant pressure PSID ("C/E PSID") defined by the manufacturer or condenser specifications. SF adjusts CWP VFD speed to balance C/E PSID (mmHg) using the minimum manufacturer value as the control set point as detailed in FIG. 6. This is advantageous because even small deviations of the C/E PSID will cause the refrigeration process to slow and crystallization to begin.

In FIG. 6 the CWP VFD starts at full speed with its ramp down timer set at a predefined time interval, such as 5 minutes. According to SF, the CWP VFD then resets its speed from that point based on the real time value C/E PSID value relative to C/E PSID AVG as shown in FIG. 6. The control sequence executes at predefined time intervals, such as every 15 seconds in this example. When the C/E PSID increases a predefined amount, such as 0.5 mmHg above the C/E PSID AVG, the CWP VFD speed is increased by a predefined amount, such as 1 Hz. In like manner, when the C/E PSID decreases 0.5 mmHg below the C/E PSID AVG the CWP VFD speed is decreased by a predefined amount, such as 1 Hz. The resultant values expected in the generator as the GP VFD changes speed are detailed in FIG. 6 as well.

D. Absorber

Condensing water entering the absorber ("AFET") must cool the strong LiBr solution for the absorber 128 to operate properly. For example, in one exemplary absorber 128 the AFET must cool the strong LiBr solution from about 105° F. to 91° F. at design conditions to allow for proper absorption of the refrigerant vapor produced in the evaporator 124. The AFET must also remove the heat of absorption caused by the combining of the refrigerant vapor and LiBr salt.

Cooler AFET temperatures provides for better absorption characteristics of the LiBr salt. However, if the AFET is below ~70° F. the LiBr salt will start precipitating out of the concentrated solution and sticking to the heat exchanger of the absorber 128. This causes a condition commonly referred to in the industry as "crystallization". Too much crystallization causes the refrigerant cycle to stop and or machine failure. It is noted that in cases where an absorber 128 and condenser 116 share the same cooling towers 132 (which is typical), the AFET can be controlled via a bypass valve 144 as the cooling tower supply water drops below the minimum AFET temperature (e.g., ~70° F.). This allows SF to drive the cooling tower 132 as low as possible down to its minimum limits at the condenser 116 (according to SF's stated goal), while avoiding crystallization. The LiBr salt absorbs the superheated refrigeration at a higher rate with reduced temperature as long as it is kept above the crystallization point.

i) Absorber Step Flow Logic

As seen previously in the Cooling Tower Load analysis Qct approximately equals Qc+Qa. It follows from this equation that Qa approximately equals Qct−Qc. As Qct−Qg are known quantities, the SF pumping rate for Qa is defined as the difference between total cooling tower load and condenser load. SF therefore adjusts AP VFD speed to balance Qa using Qct−Qc as the control set point as described in FIG. 7.

In FIG. 7 the absorber pump ("AP") 172 starts at full speed with its ramp down timer set to a predefined time interval, such as 5 minutes for example. According to SF, the AP VFD then resets its speed, shown in hertz, from that point based on the real time value of Qa relative to QaAVG as shown in FIG. 7. This control sequence executes at a predefined time interval, such as every 30 seconds. When Qa increases above a predefined amount, such as 2% above the QaAVG the AP VFD speed is increased by predefined amount, such as 2 Hz. In like manner, when Qa decreases 2% below the Qa AVG the AP VFD speed is decreased by 2 Hz. The resultant values expected in the absorber as the AP VFD changes speed are detailed in FIG. 7 as well.

E. Step Flow Air Handling Unit (AHU) Control Logic

According to SF, the distribution fan ("DF") 180 modulates, through its VFD, to control the speed of the distribution fan to a space temperature set point ("Space STPT") relative to the space temperature average temperature ("Space AVG") as shown in FIG. 8. In FIG. 8, the DF VFD starts at full speed with its ramp down timer set to a predefined time interval, such as 5 minutes in this example. According to SF, the DF VFD then resets its speed from that point based on the value of the Space AVG relative to Space STPT as shown in FIG. 8.

The control sequence executes at a predefined time interval, such as every 30 seconds for example. When Space AVG increases above a predefined amount, such as 2% above the Space STPT the DF VFD speed is increased by a predefined amount, such as 2 Hz. In like manner, when the Space AVG drops below the Space STPT, The DF VFD speed is decreased by a predefined amount, such as 2 Hz. The resultant values expected in the absorber as the AP VFD changes speed are detailed in FIG. 8 as well.

FIG. 9 provides a table showing how a two-way chilled water control valve (CHWV) modulates to control the AHU supply air temperature ("SAT") to the supply air temperature set point (SAT STPT). The SAT STPT is adjusted based on outside air dry bulb temperature. As can be seen a control device 304 that implements SF can also be used to control various control valves.

The control sequence shown in FIG. 9 may be executed at a predefined time interval, such as 15 seconds. When SAT AVG increase above SAT STPT a predefined amount, such as 2%, CHWV may be increased or opened 1% or other predefined value. Likewise, if SAT AVG is below SAT STPT a predefined amount, such as 2%, CHWV may be decreased or closed 1% or other predefined value.

Figure 10:
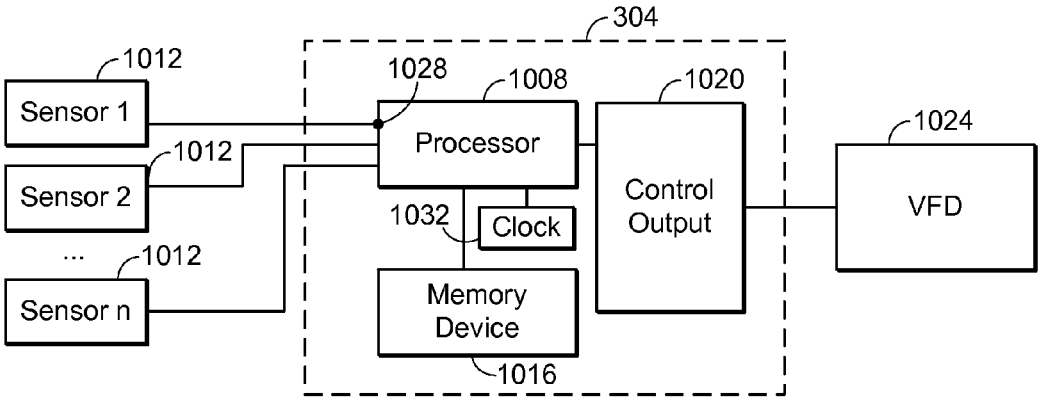
FIG. 10 is a block diagram illustrating an exemplary control device.

FIG. 10 illustrates an exemplary control device 304 configured to control absorption chiller components according to SF. As can be seen, the control device 304 may include one or more processors 1008, which may comprise one or more microcontrollers, microprocessors, circuits, or the like configured to control a VFD 1024 of a pump or fan (such as to control the flow rate of water or air, as described above).

A processor 1008 may receive input from or about an absorber, condenser, generator, evaporator or other component of an absorption chiller via one or more sensors 1012, input terminals 1024, or both during its operation. As shown, one or more sensors 1012 provide input to the control device's processor 1008 by connecting to an input terminal 1024. It is noted that an input terminal 1024 may receive input about a component of an absorption chiller from other sources as well. For instance, an input terminal 1024 may be connected to a terminal of such component to receive data directly therefrom. A variety of sensors 1012 may be used. For example, one or more temperature, current utilization, flow rate, load sensors may be used to determine a variety of corresponding operating conditions of one or more components of an absorption chiller.

A clock 1032, timer or the like may be provided to trigger activity within or relating to the control device 304. It is noted that a clock 1032 may be a separate element such as shown, or be integrated with one or more elements of the control device 304, such as a processor 1008. In operation, a clock 1032 may be used to activate one or more inputs 1028 or sensors 1012 at one or more predefined interval. For example, a clock 1032 may trigger activation of an input 1028 or sensor 1012 every 30 seconds to receive load or other information at such interval. Calculation of values and comparisons thereof may also be triggered by a clock 1032 in some embodiments. For example, the calculation of an average load value and comparison thereof (such as described below) may be triggered by a clock 1032.

In one or more embodiments, a SF control sequence comprises instructions that define the operation of the control device 304. Such instructions may be stored for retrieval and execution in a memory device 1016 accessible to or integrated in a processor 1008. In some embodiments, the processor 1008 may be hardwired with such instructions. The processor 1008 may transmit signals or commands to control a VFD 1024 via an output terminal 1020 or other communication port or connection in one or more embodiments. Some exemplary commands include start, stop, speed up or slow down commands for a VFD and its associated equipment, such as a pump or fan. A command may also or alternatively define a desired operating condition such as a desired speed, temperature or other desired operating condition. It is contemplated that the input and output terminals may communicate via various communication or signaling protocols across wired or wireless communication or signaling links.

Figure 11:
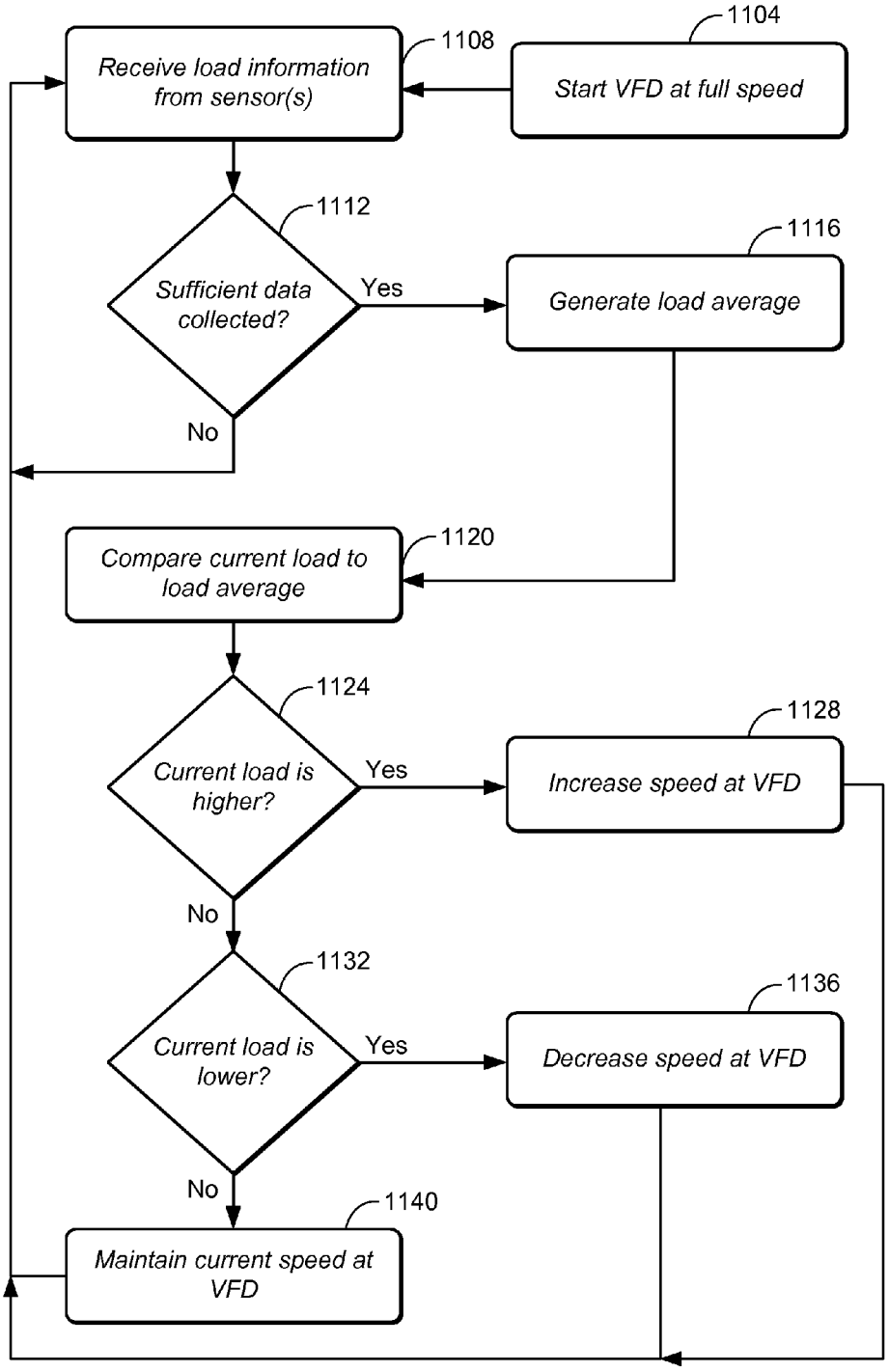
FIG. 11 is a flow diagram illustration operation of an exemplary control device.

FIG. 11 is a flow diagram illustrating operation of an exemplary control device. As can be seen at a step 1104, the control device may start a VFD (of a pump or fan) at full speed and then reduce the speed if necessary based on load information. At a step 1108, load information may periodically be received by the control device via one or more sensors or via communication with an absorption chiller component (e.g., a generator, absorber, evaporator, or condenser of an absorption chiller). Load information may comprise the current (or other) load of an absorption chiller component, such as disclosed above with regard to FIGS. 4-9.

At a decision step 1112, if sufficient load information has been collected, a load average may be calculated at a step 1116. This may be determined based on a predefined value stored in memory. For example, if four different measurements of load information is defined as sufficient, a load average may be calculated at step 1116 with the values in the collected load information once this requirement is met. It is contemplated that an operator or user may define how many measurements are sufficient. If insufficient information has been collected, additional load information may be received at step 1108. Once a load average is generated, it may be compared to a current load value at a step 1120.

It is contemplated that an average value is not required in all embodiments for the comparison step 1120. For instance, a control device may be configured to compare two different individual values at a step 1120. For example, in the AHU SAT control sequence described above with regard to FIG. 9, a control device may directly compare SAT STPT and outside air dry bulb temperature. In such embodiment, SF may proceed from receiving load information from one or more sensors at step 1108 directly to the comparison step 1120, where individual load values from the load information are compared.

At a decision step 1124, if the current load value is higher than the load average, speed at the VFD may be increased by appropriate signaling from the control device to the VFD. This occurs at step 1128, such as via a signal or command generated by the processor of the control device and transmitted to the VFD.

It is noted that the control device's memory device may store a table, instructions or other data governing the amount speed at a VFD is changed for a given difference between the load average and current load value. This is alluded to above, where speed is increased or decreased a variable amount depending on the component of an absorption cooler being acted upon by a control device and VFD.

At a decision step 1132, if the current load value is lower than the load average, speed at the VFD may be decreased by the control device at a step 1136, also by transmitting a signal to the VFD. A decrease in speed may also be defined by a table, instructions or other data such as that disclosed above. If the current load is similar (i.e., within a predefined range) or identical to the load average, the current VFD speed is maintained, such as shown in a step 1140. The control device may receive load information and make speed adjustment continuously or periodically.

Though illustrated in FIG. 11 as increasing speed when the current load is higher than an average load and decreasing speed when the current load is lower than the average load, it is noted that a SF control sequence may increase speed when the current load is lower than the average load and decrease speed when the current load is higher than the average load, as disclosed above. In addition, a SF control sequence need not always operate upon load values. For example, SF may operate based on current temperature and average temperature values (as described above) received from its control device's sensor(s) or input terminal(s).

Operating conditions and advantages of SF will now be described with regard to FIGS. 12-13. FIG. 12 is a table illustrating various operating conditions as load decreases in an absorption chiller operating without SF. FIG. 13 is a table illustrating the conditions in the absorption chiller when utilizing SF. In both FIGS. 12-13, load is shown in the leftmost "tons" column, which decreases from top to bottom. Each row shows corresponding values for the other measurements without SF in the case of FIG. 12 and with SF in the case of FIG. 13. Of note are the differences in the chilled water return temperature (CHWR) at the adsorption chiller's evaporator, as well as condenser water supply temperature (CWS), and condenser water supply enthalpy (CWS H1) at the adsorption chillers condenser without and with SF, as respectively shown in FIGS. 12-13.

With regard to the absorption chiller's condenser of FIG. 12, it can be seen from the CWS value that the condenser is operating at a consistently high load despite the decrease in overall system tons. Specifically, CWS is held at 88° F. by the condenser even as load decreases from 10 tons to 1 ton. Likewise, CWS H1 is held constant by the condenser at 56.04 regardless of actual system load. Though operating the condenser in this manner does succeed in condensing refrigerant solution while preventing crystallization, it is also highly inefficient.

In contrast, when operating with SF, it can be seen that condenser conditions are varied depending on load resulting in increased efficiency while also preventing crystallization. As can be seen by the exemplary condenser operating values of FIG. 13, CWS is lowered as load decreases. It is noted that SF will typically be configured to maintain a minimum CWS temperature according to the condenser's specification so that CWS temperature does not fall below a required minimum. Similarly, CWS H1 is also reduced as load decreases as long as it does not fall below its required minimum. The lower CWS temperature results in increased efficiency at the condenser.

FIGS. 12-13 also respectively show the difference between CHWR at an evaporator without and with SF. As can be seen in FIG. 13, operating according to SF advantageously results in a substantially constant CHWR temperature at the evaporator near or at evaporator design specifications even as load decreases. This allows the evaporator to operate in ideal conditions according to its specifications thereby allowing it to achieve its design efficiency (or near design efficiency). In contrast, the evaporator without SF of FIG. 12 must operate with increasing lower CHWR temperatures as load decreases. This prevents the evaporator from achieving the efficiency it is design to achieve thus lowering overall system efficiency as well.

The rightmost columns of FIG. 13 show the efficiency of the absorption chiller (COP) with SF as well as the increase in COP in comparison to COP for the same absorption chiller without SF, as shown in the rightmost column of FIG. 12. As can be seen, operating an absorption chiller according to SF results in a substantial increase in efficiency even as load changes. This is highly advantageous in that absorption chillers rarely operate at constant load, if at all.

While various embodiments of the invention have been described, it will be apparent to those of ordinary skill in the art that many more embodiments and implementations are possible that are within the scope of this invention. In addition, the various features, elements, and embodiments described herein may be claimed or combined in any combination or arrangement.

What is claimed is:

1. A control device for controlling an absorption chiller comprising:
- an input configured to receive a plurality of load values from at least a first and a second component of the absorption chiller;
- a memory device storing a control sequence defining a speed increase and a speed decrease in hertz;
- an output that communicates with a variable frequency drive of the second component; and
- a processor that:
  - averages a predefined number of the plurality of load values to generate a first average load value, wherein the predefined number of the plurality of load values are from the first component;
  - averages a subset of the plurality of load values to generate a second average load value, wherein the subset of the plurality of load values is from the second component;
  - compares the first average load value to the second average load value to determine whether the first average load value is greater or less than the second average load value; and
  - increases speed at the variable frequency drive by the speed increase or decreases speed at the variable frequency drive by the speed decrease based on the comparison of the first average load value to the second average load value.

2. The control device of claim 1, wherein the processor only increases or decreases speed at the variable frequency drive when the comparison reveals that the average load value is larger than the one of the plurality of load values by at least a predefined threshold amount.

3. The control device of claim 1 further comprising a clock, wherein the input receives each of the plurality of load values at a predefined interval defined by the clock.

4. The control device of claim 1, wherein the processor initially commands the variable frequency drive of the component to start at full speed via the output.

5. The control device of claim 1, wherein the component is selected from the group consisting of an evaporator, absorber, heat exchanger, generator and condenser of the absorption chiller.

6. A controller for an absorption chiller comprising:
- one or more inputs that receive a plurality of load values from an absorption chiller component selected from the group consisting of an evaporator, absorber, heat exchanger, generator and condenser;
- one or more outputs that transmit one or more control signals to a variable frequency drive of the absorption chiller component; and
- one or more processors that:
  - receive the plurality of load values received by the one or more inputs;
  - generate an average load value from a subset of the plurality of load values when a predefined number of load values has been received;

compare the average load value to one of the plurality of load values, wherein the one of the plurality of load values is more recent in time relative to the subset of the plurality of load values; and increase or decrease speed at the variable frequency drive by at least one of a plurality of predefined frequencies based on the difference of the average load value to the one of the plurality of load values.

7. The controller of claim 6 further comprising a memory device storing the plurality of predefined frequencies.

8. The controller of claim 6, wherein the processor only increases or decreases speed at the variable frequency drive when the comparison reveals that the average load value is larger or smaller than the one of the plurality of load values by at least a predefined threshold amount.

9. The controller of claim 6 further comprising a clock, wherein the one or more inputs receive each of the plurality of load values at a predefined interval defined by the clock.

10. The controller of claim 6, wherein the processor initially commands the variable frequency drive of the component to start at full speed via the output.

11. The controller of claim 6 further comprising one or more sensors in communication with the one or more inputs, wherein the plurality of load values are determined by the sensors.

12. A control device implemented method for controlling an absorption chiller comprising:

receiving a plurality of load values from a component of the absorption chiller via one or more sensors, wherein receipt of each of the plurality of load values is triggered by a clock of the control device;

determining if a predefined number of load values have been received via a processor of the control device;

upon receiving the predefined number of load values, generating an average load value from a subset of the plurality of load values with the processor;

comparing the average load value to a selected one of the plurality of load values, wherein the one of the plurality of load values is more recent in time relative to the subset of the plurality of load values; and increasing or decreasing the speed at a variable frequency drive of the component by at least one of a predefined plurality of frequencies based on the difference between the average load value and the selected one of the plurality of load values, wherein the speed is only increased or decreased if the difference is larger than a predefined threshold amount.

13. The controller implemented method of claim 12, wherein increasing or decreasing the speed occurs by signaling the variable frequency drive with an output of the control device.

14. The controller implemented method of claim 12 further comprising storing the plurality of predefined frequencies on a memory device of the control device.

15. The controller implemented method of claim 12, wherein the clock triggers receipt of each of the plurality of load values at a static predefined time interval.

16. The controller implemented method of claim 12, wherein the component is selected from the group consisting of an evaporator, absorber, heat exchanger, generator and condenser of the absorption chiller.

17. The controller implemented method of claim 12 further comprising initializing the component by signaling its variable frequency drive to start at full speed via an output of the control device.

* * * * *